US010414166B2

(12) United States Patent
Nakano

(10) Patent No.: US 10,414,166 B2
(45) Date of Patent: Sep. 17, 2019

(54) LIQUID JETTING APPARATUS

(71) Applicant: BROTHER KOGYO KABUSHIKI KAISHA, Nagoya-shi, Aichi-ken (JP)

(72) Inventor: Yasuhiro Nakano, Nagoya (JP)

(73) Assignee: BROTHER KOGYO KABUSHIKI KAISHA, Nagoya-shi, Aichi-ken, (JP)

( * ) Notice: Subject to any disclaimer, the term of this patent is extended or adjusted under 35 U.S.C. 154(b) by 2 days.

(21) Appl. No.: 15/729,844

(22) Filed: Oct. 11, 2017

(65) Prior Publication Data

US 2018/0099508 A1 Apr. 12, 2018

(30) Foreign Application Priority Data

Oct. 11, 2016 (JP) ..... 2016-200083

(51) Int. Cl.

| | |
|---|---|
| ***B41J 2/175*** | (2006.01) |
| ***B41J 2/165*** | (2006.01) |
| ***B41J 2/195*** | (2006.01) |
| ***B41J 29/38*** | (2006.01) |

(52) U.S. Cl.

CPC ..... *B41J 2/17566* (2013.01); *B41J 2/1652* (2013.01); *B41J 2/16526* (2013.01); *B41J 2/175* (2013.01); *B41J 2/17509* (2013.01); *B41J 2/17523* (2013.01); *B41J 2/195* (2013.01); *B41J 29/38* (2013.01); *B41J 2/16505* (2013.01); *B41J 2/16517* (2013.01); *B41J 2/17533* (2013.01); *B41J 2002/16573* (2013.01)

(58) Field of Classification Search

CPC ..... B41J 2002/16573; B41J 29/38; B41J 2/16505; B41J 2/16517; B41J 2/1652; B41J 2/16526; B41J 2/175; B41J 2/17509; B41J 2/17523; B41J 2/17533; B41J 2/17566; B41J 2/195

USPC ..... 358/1.13, 1.5

See application file for complete search history.

(56) References Cited

U.S. PATENT DOCUMENTS

2003/0112286 A1 6/2003 Shindo
2005/0219281 A1* 10/2005 Seino ..... B41J 2/17523 347/6

(Continued)

FOREIGN PATENT DOCUMENTS

| | | |
|---|---|---|
| JP | 2005-059304 A | 3/2005 |
| JP | 2009-184360 A | 8/2009 |
| JP | 2016-043625 A | 4/2016 |

*Primary Examiner* — Negussie Worku

(74) *Attorney, Agent, or Firm* — Scully, Scott, Murphy & Presser, P.C.

(57) ABSTRACT

A liquid jetting apparatus includes: a jetting unit connected to a tank storing liquid, and having jetting ports for jetting the liquid supplied from the tank; a purge unit which performs a purge operation for discharging the liquid from the jetting unit; a notifying unit which notifies a user selectively that a remaining amount of the liquid in the tank is included in a first range, and that the remaining amount is included in a second range greater than the first range; and a controller configured to: determine a first purge amount; detect the remaining amount; and in a case that the detected remaining amount is included in a third range greater than the second range and that the remaining amount is included in the first range if the purge operation is executed with the first purge amount, determine a second purge amount obtainable by reducing the first purge amount.

14 Claims, 12 Drawing Sheets

(56) References Cited

U.S. PATENT DOCUMENTS

| | | | | |
|---|---|---|---|---|
| 2010/0053257 | A1* | 3/2010 | Kubo | B41J 2/16526 347/30 |
| 2011/0050765 | A1* | 3/2011 | Nishida | B41J 2/16526 347/6 |
| 2011/0050796 | A1* | 3/2011 | Nishida | B41J 2/16526 347/29 |
| 2012/0249670 | A1* | 10/2012 | Sugahara | B41J 2/16526 347/26 |
| 2012/0262508 | A1* | 10/2012 | Steurrys | B41J 2/16538 347/6 |
| 2014/0240395 | A1* | 8/2014 | Shindo | B41J 2/16523 347/29 |
| 2016/0052276 | A1 | 2/2016 | Tenkawa et al. | |
| 2016/0089987 | A1* | 3/2016 | Ichikawa | B60L 11/182 701/22 |
| 2017/0136771 | A1* | 5/2017 | Ogawa | B41J 2/16511 |
| 2018/0181433 | A1* | 6/2018 | Emperle | G06F 13/24 |
| 2018/0215161 | A1* | 8/2018 | Koizumi | B41J 2/175 |

* cited by examiner

LIQUID JETTING APPARATUS

CROSS REFERENCE TO RELATED APPLICATION

The present application claims priority from Japanese Patent Application No. 2016-200083 filed on Oct. 11, 2016 the disclosure of which is incorporated herein by reference in its entirety.

BACKGROUND

Field of the Invention

The present invention relates to a liquid jetting apparatus provided with a jetting unit configured to be connectable to a tank storing liquid, and a purge unit configured to perform a purge operation for causing the jetting unit to discharge the liquid.

Description of the Related Art

Conventionally, there is known a technique for reducing a jetting amount of an ink to be jetted in a cleaning operation (purge operation) in a case that a remaining amount of the ink in an ink tank is not more than a predetermined value (see, for example, Japanese Patent Application Laid-open No. 2005-59304).

SUMMARY

According to the above-described conventional technique, provided that the remaining amount of the ink in the tank is classified in three ranges which are a first range, a second range and a third range (the first range< the second range< the third range), then there may arise such a situation. Namely, as a result of performing the purge operation while reducing a purge amount, in a case that the remaining amount is included in (is within) the third range, the remaining amount is decreased and thus included in (to be within) the first range. In such a configuration that separate notifications are issued respectively in a case that the remaining amount is included in the first range and in a case that the remaining amount is included in the second range, provided that the remaining amount is decreased from the third range to the first range due to one time of the purge operation, then any time cannot be secured for allowing an user, who receives the notification regarding the second range, to prepare a replacement of the tank or to replenish the tank with the liquid.

It is also conceivable not to perform the purge operation so as to prevent the remaining amount from decreasing from the third range to the first range due to one time of the purge operation. However, in such a case, it is necessary to replace the tank or to replenish the tank with the liquid in a state that the remaining amount is relatively large (the remaining amount is in the third range), which in turn might cause a problem such as a wasteful discarding of a non-used liquid, an increased burden on the user, etc.

An object of the present teaching is to provide a liquid jetting apparatus which is capable of reducing any wasteful discarding of a non-used liquid, any increased burden on the user, etc, and after the execution of the purge operation in a state that the remaining amount is in the third range, which is capable of securing a time for allowing the user, who receives the notification regarding the second range, to prepare the replacement of the tank or to replenish the tank with the liquid.

According to an aspect of the present teaching, there is provided a liquid jetting apparatus including: a jetting unit connected to a tank storing liquid, and having jetting ports through which the liquid supplied from the tank is jetted; a purge unit configured to perform a purge operation for discharging the liquid from the jetting unit, a notifying unit configured to notify a user selectively that a remaining amount, of the liquid remaining in the tank, is included in a first range; and that the remaining amount is included in a second range greater than the first range; and a controller configured to control the jetting unit, the purge unit and the notifying unit, wherein the controller is configured to: determine a first purge amount which is an amount of the liquid to be discharged in the purge operation; detect the remaining amount; in a case that the detected remaining amount is included in a third range greater than the second range, and that the remaining amount is included in the first range if the purge operation is executed with the first purge amount, determine a second purge amount which is obtainable by reducing the first purge amount, such that the remaining amount is included in the second range after the purge operation is executed with the second purge amount, control the purge unit to discharge the liquid in the second purge amount; and control the notifying unit to notify the user that the remaining amount is included in the second range, after the liquid has been discharged in the second purge amount.

According to the present teaching, in the case that the remaining amount is in the first range if the purge operation is executed with the first purge amount in a state that the remaining amount is in the third range, the purge operation is executed with the second purge amount which causes the remaining amount to be in the second range after the purge operation. Therefore, after the purge operation is executed in the state that the remaining amount is in the third range, the user can receive the notification regarding the second range. Thus, it is possible to secure the time allowing the user to prepare the replacement of the tank or the replenishment of the tank with the liquid. Further, since there arises no need to replacement the tank or to replenish the tank with the liquid in a state that the remaining amount is in the third range, it is possible to prevent any wasteful discarding of the non-used ink and/or to reduce the burden on the user.

DESCRIPTION OF THE EMBODIMENTS

Figure 1:
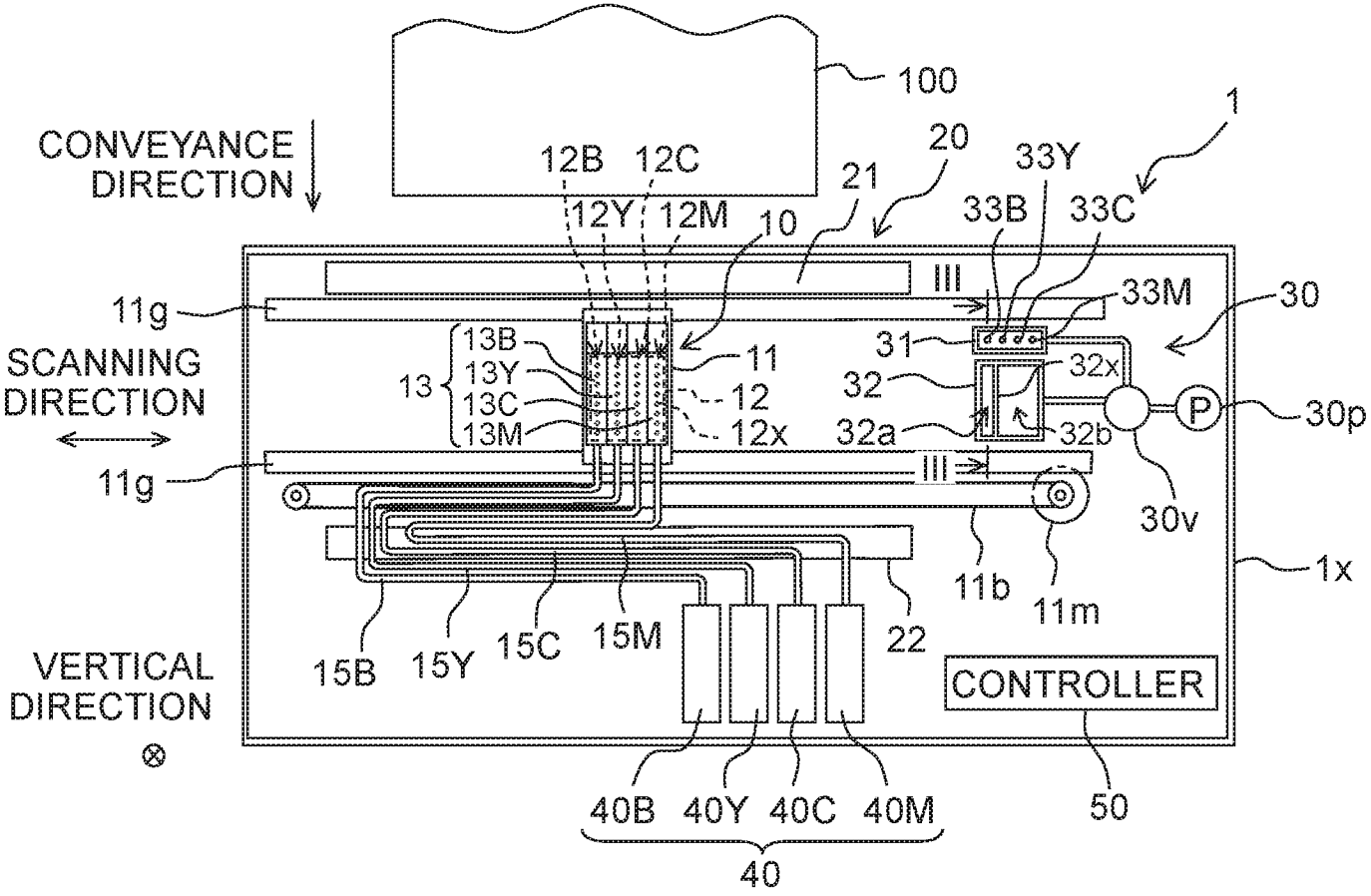
FIG. 1 is a plane view of a printer according to an embodiment of the present teaching.

A printer 1 according to an embodiment of the present teaching has a casing 1*x*, as depicted in FIG. 1. A jetting unit 10, a conveyance unit 20, a maintenance unit 30, a cartridge unit 40 and a controller 50 are arranged in the casing 1*x*.

The cartridge unit 40 includes four cartridges (replaceable tanks) 40B, 40Y, 40C and 40M, and inks which are black, yellow, cyan, magenta inks are stored in the four cartridges 40B, 40Y, 40C and 40M, respectively. The color (yellow, cyan, magenta) cartridges 40Y, 40C and 40M are integrally formed. The black cartridge 40B and the color cartridges 40Y, 40C, 40M are independently detachable and attachable with respect to the casing 1*x*.

The jetting unit 10 includes a carriage 11, a head 12 and a sub tank unit 13 which are mounted on the carriage 11.

The carriage 11 is supported by two guide shafts 11*g* extending in a scanning direction, and a carriage motor 11*m* is driven to thereby run an endless belt 11*b*, which in turn moves the carriage 11 in a reciprocating manner.

Figure 2:
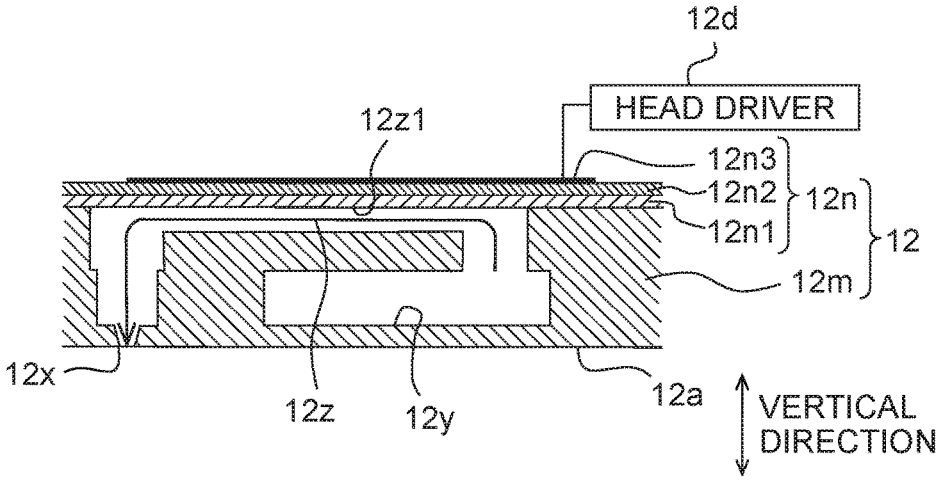
FIG. 2 is a partial cross-sectional view of a head in the printer according to the embodiment of the present teaching.

As depicted in FIG. 2, the head 12 includes a channel unit 12*m*, and an actuator unit 12*n*.

The lower surface of the channel unit 12*m* is a jetting surface 12*a* in which a plurality of jetting ports 12*x* are opened. As depicted in FIG. 1, the plurality of jetting ports 12*x* are aligned along a conveyance direction, and form four jetting port rows 12B, 12Y, 12C and 12M. The four jetting port rows 12B, 12Y, 12C and 12M are arranged side by side in the scanning direction. Each of the jetting port rows 12B, 12Y, 12C and 12M is composed of the plurality of jetting ports 12*x* through which any one of the inks that are the black, yellow, cyan and magenta is jetted.

As depicted in FIG. 2, common channels 12*y* each of which is provided for one of the colors the jetting port rows 12B, 12Y, 12C and 12M), and individual channels 12*z* each of which is provided for one of the discharge ports 12*x* are formed in the channel unit 12*m*. Each of the individual channels 12*z* is a channel spanning from the outlet of a common channel 12*y*, of which color corresponds to that of the individual channel 12*z*, and reaching one of discharge ports 12*x* corresponding thereto via a pressure chamber 12*z*1 corresponding thereto. A plurality of pressure chambers 12*z*1 are formed to open in the upper surface of the channel unit 12*m*.

The actuator unit 12*n* includes a vibration plate 12*n*1 which is arranged on the upper surface of the channel unit 12*m* so as to cover the plurality of pressure chambers 12*z*1, a piezoelectric layer 12*n*2 which is arranged on the upper surface of the vibration plate 12*n*1, and a plurality of individual electrodes 12*n*3 which are arranged on the upper surface of the piezoelectric layer 12*n*2 so as to face the plurality of pressure chambers 12*z*1, respectively. Parts or portions, of the vibration plate 12*n*1 and the piezoelectric layer 12*n*2, which are sandwiched between each of the pressure chambers 12*z*1 corresponding thereto and one of the individual electrodes 12*n*3 corresponding thereto function as an individual unimorph-type actuator for each of the pressure chambers 12*z*1. These parts are individually deformable by application of a voltage to each of the individual electrodes 12*n*3 by a head driver 12*d*. In a case that the actuator is deformed so as to project toward the pressure chamber 12*z*1, the volume in the pressure chamber 12*z*1 is thus decreased. At this time, pressure is applied to the ink inside the pressure chamber 12*z*1, thereby causing the ink to be jetted from the jetting port 12*x*.

As depicted in FIG. 1, the sub tank unit 13 includes four sub tanks 13B, 13Y, 13C and 13M. The four sub tanks 13B, 13Y, 13C and 13M store the black, yellow, cyan and magenta inks, respectively. The four sub tanks 13B, 13Y, 13C and 13M are connected to the four cartridges 40B, 40Y, 40C and 40M via flexible tubes 15B, 15Y, 15C and 15M, respectively.

Since the configurations of the four sub tanks 13B, 113Y, 113C and 13M are mutually same, the following explanation will be given about the sub tank 13B depicted in FIG. 3, as an example.

Figure 3:
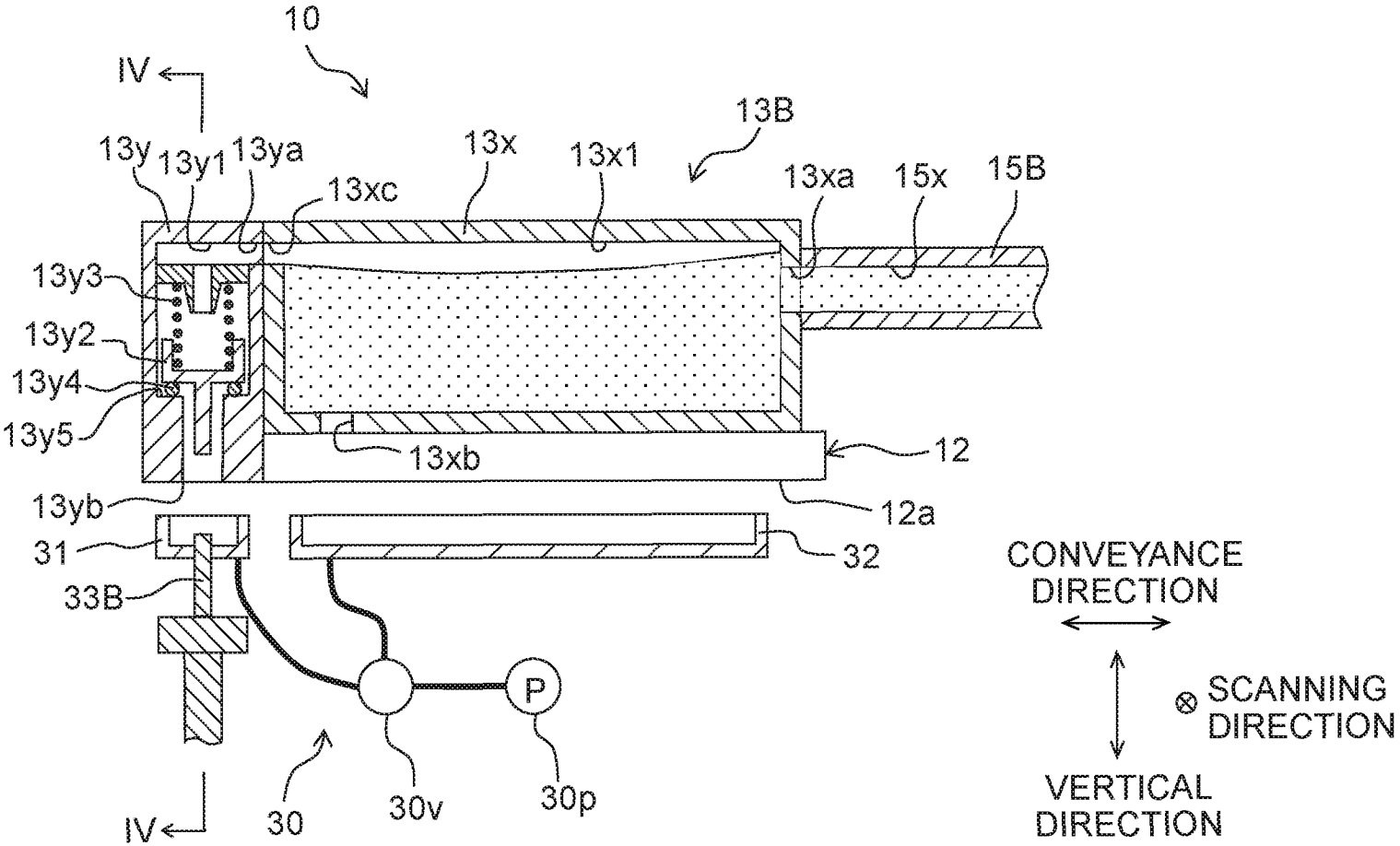
FIG. 3 is a cross-sectional taken along a III-III line in FIG. 1 in a state that a carriage is located at a maintenance position in the printer according to the embodiment of the present teaching.

Each of the sub tanks 13B, 13Y, 13C and 13M has an ink storing part 13*x* and an exhaust part 13*y*, as depicted in FIG. 3.

An ink storing chamber 13*x*1 is formed in the ink storing part 13*x*.

The ink storing chamber 13*x*1 is communicated with an ink channel 15*x* inside of one of the tubes 15B, 15Y, 15C and 15M corresponding thereto, via a through hole 13*xa* formed in a side wall on one side of the ink storing chamber 13*x*. The ink entering into the ink storing chamber 13*x*1 and the ink channel 15*x* resides in an upper part of the ink storing chamber 13*x*1.

The ink storing chamber 13*x*1 is communicated with a common channel 12*y* formed in the head 12 and corresponding to the ink storing chamber 13*x*1, via a through hole 13*xb* formed in the lower wall of the ink storing part 13*x*. The ink, which is supplied to each of the sub tanks 13B, 13Y, 13C and 13M from one of the cartridges 40B, 40Y, 40C and 40M via one of the tubes 15B, 15Y, 15C and 15M corresponding thereto, is stored temporarily in the ink storing chamber 13*x*1, and then is supplied to the head 12 from the through hole 13*xb*.

An exhaust channel 13*y*1 is formed in the exhaust part fly. The exhaust channel 13*y*1 is communicated with the ink storing chamber 13*x*1 via a through hole 13*ya* formed in a side wall on one side of the exhaust part 13*y* and via a through hole 13*xc* formed in a side wall on the other side of the ink storing part 13*x*. Further, the exhaust channel 13*y*1 is capable of communicating with a space located below the exhaust part 13*y* via an exhaust port 13*yb* formed in the lower surface of the exhaust part 13*y*.

A valve 13*y*2, a coil spring 13*y*3 which urges the valve 13*y*2 downwardly and an O-ring 13*y*4 which is fixed to the lower surface of the valve 13*y*2 are disposed inside the exhaust part 13*y*. The valve 13*y*2 is urged by the coil spring 13*y*3 and thus is brought into contact with a valve seat 13*y*5 via the O-ring 13*y*4, thereby cutting off (blocking) the communication between the exhaust channel 13*y*1 and the space located below the exhaust part 13*y*.

As depicted in FIG. 1, the conveyance unit 20 includes a conveyance roller pair 21 arranged on the upstream side in the conveyance direction with respect to the head 12, and a conveyance roller pair 22 arranged on the downstream side in the conveyance direction with respect to the head 12, and conveys a paper (an exemplary recording medium) 100 in the conveyance direction. Each of the conveyance roller pairs 21 and 22 includes a driving roller and a driven roller which are arranged so as to nip the paper 100 therebetween. A conveyance motor 20*m* (see FIG. 6) is driven to thereby rotate the driving roller, which in turn causes the driving roller and the driven roller to rotate in mutually opposite directions.

The ink(s) is (are) jetted from the jetting ports 12*x* of the head 12, which reciprocates together with the carriage 11 in the scanning direction, onto a surface of the paper 100 which is being conveyed in the conveyance direction by the conveyance unit 20, thereby recording a letter, image, etc. on the surface of the sheet 100.

The maintenance unit 30 is provided to restore the jetting performance of the head 12, and includes an exhaust cap 31, a nozzle cap 32, a suction pump 30*p* and a switching device 30*v*.

As depicted in FIG. 3, in a case that the carriage 11 is located at a maintenance position, the exhaust cap 31 faces the lower surface of the exhaust part 13*y* of each of the four sub tanks 13B, 13Y 13C and 13M. In a case that an exhaust cap ascending/descending motor 31*m* (see FIG. 6) is driven in this state, the exhaust cap 31 is moved upwardly. As a result, the exhaust cap 31 is brought into contact with the lower surface of the exhaust part 13*y* of each of the four sub tanks 13B, 13Y, 13C and 13M, thereby covering the exhaust port 13*yb* of each of the four sub tanks 13B, 13Y, 13C and 13M.

Figure 4:
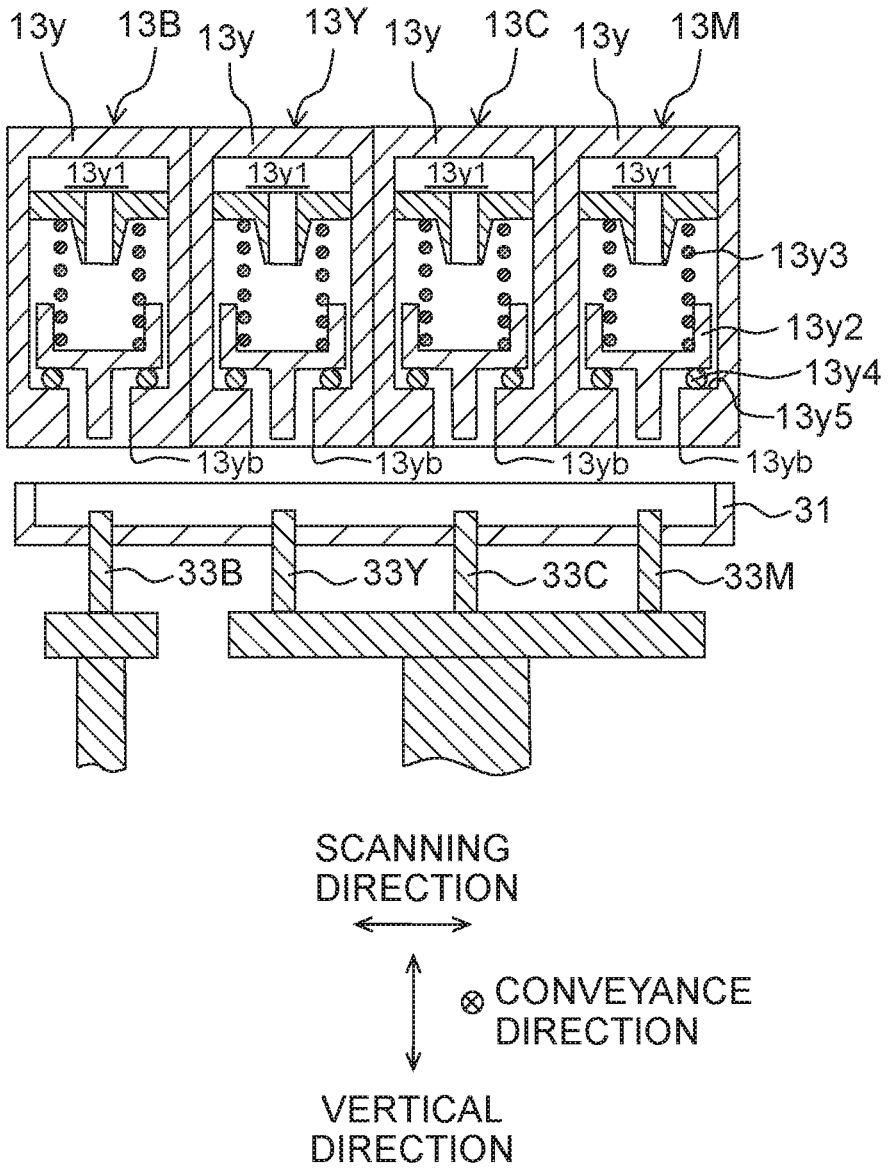
FIG. 4 is a cross-sectional view taken along a IV-IV line in FIG. 3.

As depicted in FIGS. 1 and 4, the exhaust cap 31 is provided with four opening/closing members 33B, 33Y, 33C and 33M corresponding to the four sub tanks 13B, 13Y, 13C and 13M, respectively. As depicted in FIG. 4, each of the opening/closing members 33B, 33Y, 33C and 33M extends in the vertical direction, and penetrates through the lower wall of the exhaust cap 31 in a state that the airtightness is maintained. The opening/closing member 33B for the sub tank 13B storing the black ink is configured to independently move in the vertical direction by the driving of an opening/closing member ascending/descending motor 33*m*1 (see FIG. 6). The opening/closing members 33Y, 33C and 33M for the sub tanks 13Y, 13C and 13M storing the color inks are connected to one another at lower ends thereof, and are configured to move integrally in the vertical direction by the driving of an opening/closing member ascending/descending motor 33*m*2 (see FIG. 6). Namely, the opening/closing member 33B for the sub tank 13B and the opening/closing members 33Y, 33C and 33M for the sub tanks 13Y, 13C and 13M are movable in the vertical direction independently from each other, with respect to the exhaust cap 31.

By driving the opening/closing member ascending/descending motors 33*m*1 and 33*m*2 respectively (see FIG. 6) in a state of the exhaust cap 31 closing the exhaust ports 13*yb* of the four sub tanks 13B, 13Y, 13C and 13M, the opening/closing members 33B, 33Y, 33C and 33M are moved upwardly and thus the opening/closing members 33B, 33Y, 33C and 33M are inserted into the exhaust channels 13*y*1 from the exhaust ports 13*yb*, respectively. In this situation, each of the opening/closing members 33B, 33Y, 33C and 33M causes the valve 13*y*2 to move upwardly against the urging force of the coil spring 13*y*3. With this, the valves 13*y*2 and the O-rings 13*y*4 are separated away from the valve seats 13*y*3, respectively, thereby allowing each of the exhaust channels 13*y*1 to communicate with the space (exhaust cap 31) located below the exhaust parts 13*y*.

As depicted in FIG. 3, in a case that the carriage 11 is located at the maintenance position, the nozzle cap 32 faces the jetting surface 12*a*. In a case that a nozzle cap ascending/descending motor 32*m* (see FIG. 6) is driven in this state, the nozzle cap 32 is moved upwardly, and thus the nozzle cap 32 is brought into contact with the jetting surface 12*a*. Note that as depicted in FIG. 1, the nozzle cap 32 is comparted by a partition wall 32*x* into a space 32*a* which covers the jetting port row 12B of the black ink and a space 32*b* which covers the jetting port rows 12Y, 12C and 12M of the color inks. Namely, in a case that the nozzle cap 32 is moved upwardly, the nozzle cap 32 covers the jetting port row 12B of the black ink and the jetting port rows 12Y, 12 and 12C of the color inks separately from each other.

The suction pump 30*p* is connected to each of the exhaust cap 31, the space 32*a* of the nozzle cap 32 and the space 32*b* of the nozzle cap 32, via tubes and the switching device 30*v*. The switching device 30*v* is capable of being located selectively at a position at which the switching device 30*v* allows the suction pump 30*p* to communicate with the exhaust cap 31, a position at which the switching device 30*v* allows the suction pump 30*p* to communicate with the space 32*a*, and a position at which the switching device 30*v* allows the suction pump 30*p* to communicate with the space 32*b*. Namely, the suction pump 30*p* is connected selectively with any one of the exhaust cap 31, the space 32*a* and the space 32*b*.

Figure 5A:
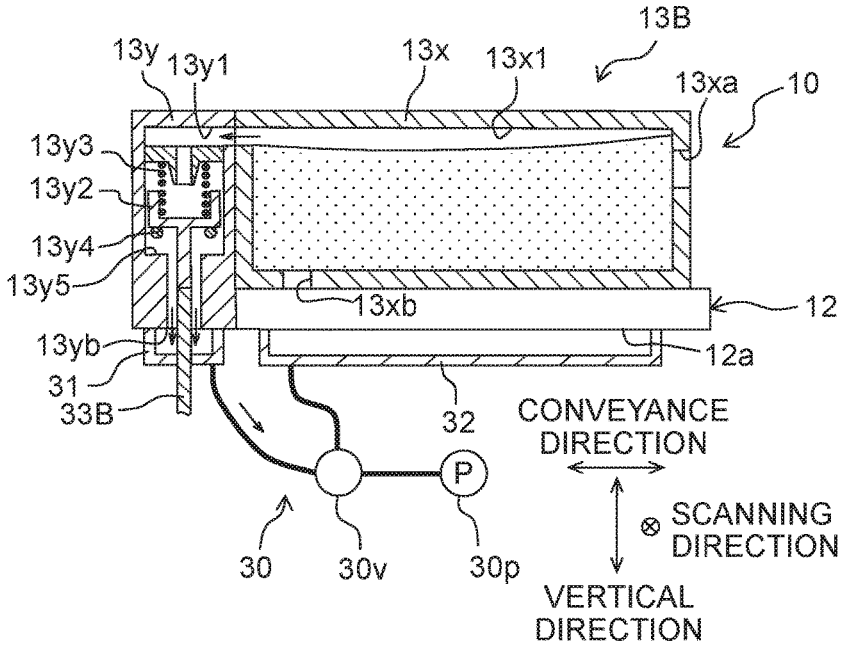
FIG. 5A is a cross sectional view, corresponding to FIG. 3, in a state that an exhaust purge operation is being executed.

In a case that the suction pump 30*p* is driven in a state that the switching device 30*v* is located at the position at which the switching device 30*v* allows the suction pump 30*p* to communicate with the exhaust cap 31, that the exhaust cap 31 covers the exhaust ports 13*yb* of the four sub tanks 13B, 13Y, 13C and 13M, and that the exhaust channels 13*y*1 and the exhaust cap 31 are communicated with each other, then the pressure inside the exhaust cap 31 is lowered. With this, the air residing in the upper part of each of the ink storing chambers 13*x*1 is exhausted together with the ink in each of the ink storing chambers 13*x*1, via the exhaust channel 13*y*1 (exhaust purge operation: see FIG. 5A).

Figure 5B:
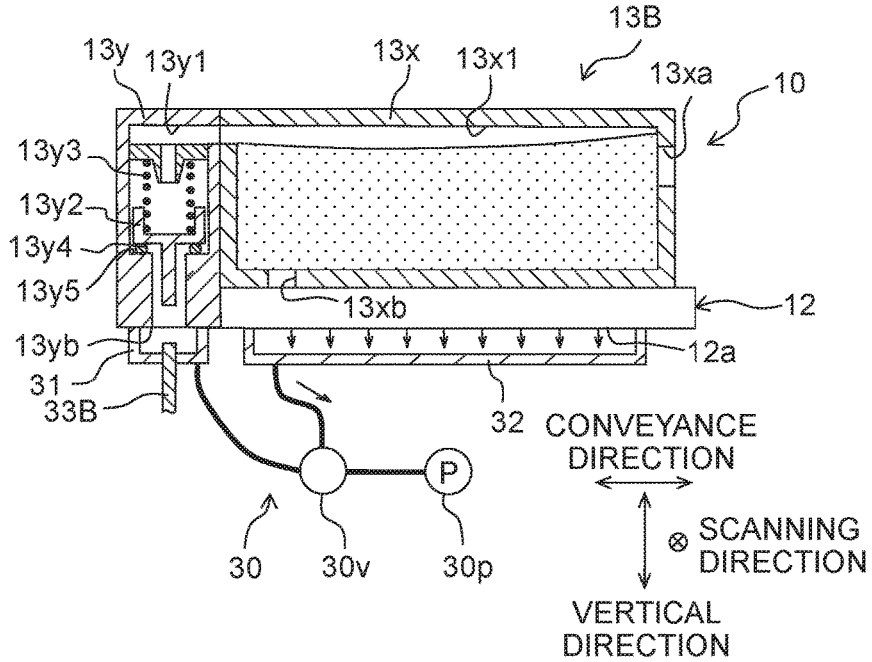
FIG. 5B is a cross sectional view, corresponding to FIG. 3, in a state that a liquid purge operation is being executed.

In a case that the suction pump 30*p* is driven in a state that the switching device 30*v* is located at the position at which the switching device 30*v* allows the suction pump 30*p* to communicate with the space 32*a*, that the nozzle cap 32 covers the jetting surface 12*a*, then the pressure inside the space 32*a* is lowered and causes the black ink to be discharged, via the plurality of jetting ports 12*x* constructing the jetting port row 12B (liquid purge operation: see FIG. 5B). In a case that the suction pump 30*p* is driven in a state that the switching device 30*v* is located at the position at which the switching device 30*v* allows the suction pump 30*p* to communicate with the space 32*b*, that the nozzle cap 32 covers the jetting surface 12*a*, then the pressure inside the space 32*b* is lowered and causes the color inks to be discharged, via the plurality of jetting ports 12*x* constructing the jetting port rows 12Y, 12C and 12M (liquid purge operation: see FIG. 5B).

Namely, the suction pump 30*p* functions as a purge unit executing the purge operation (including the exhaust purge operation and the liquid purge operation) for discharging the ink(s) (liquid(s)) from the jetting unit 10.

Figure 6:
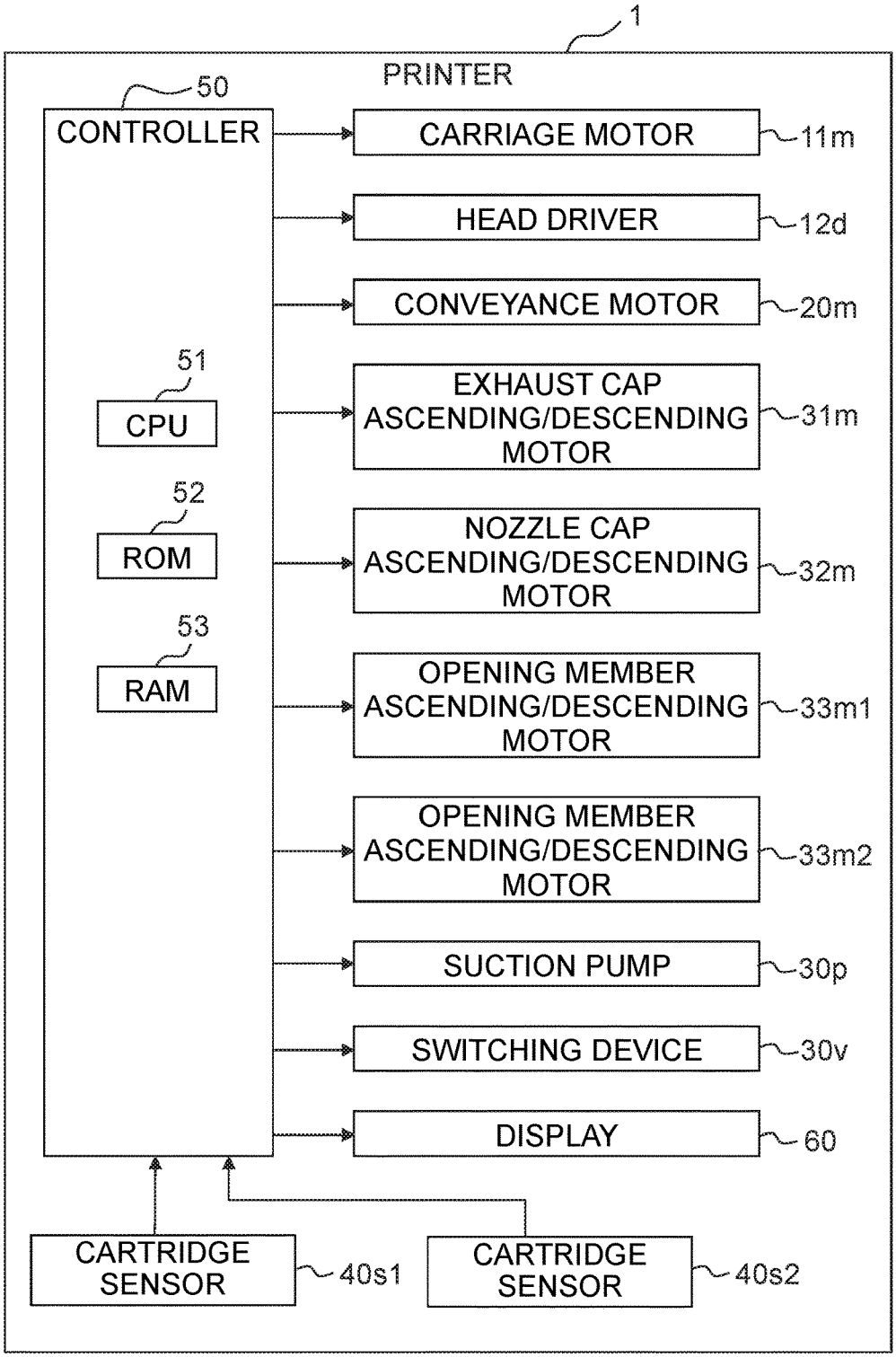
FIG. 6 is a block diagram depicting an electrical configuration of the printer according to the embodiment of the present teaching.

As depicted in FIG. 6, the controller 50 includes a CPU (Central Processing Unit) 51, a ROM (Read Only Memory) 52 and a RAM (Random Access Memory) 53, and controls the respective parts (sections, components, etc.) of the printer 1. The CPU 51 controls the carriage motor 11*m*, a head driver 11*d* and the conveyance motor 20*m* based on image data transmitted from an external apparatus (for example, a PC connected to the printer 1) to perform recording on the paper 100 (recording processing). Further, the CPU 51 executes a processing regarding the purge operation, as will be described in detail later on. A program which is executed by the CPU 51, a variety of kinds of fixed data, etc., are stored in the ROM 52. Data (such as image data, etc.) necessary for the CPU 51 to execute the program is temporarily stored in the RAM 53.

In addition to the respective elements (parts, components, etc, s described above, a display 60 and cartridge sensors 40*s*1 and 40*s*2 are connected to the controller 50.

The display 60 is disposed, for example, on the outer surface of the casing Ix, and outputs an image notifying a user of a remaining amount of the ink in the black cartridge 40B (hereinafter referred to as the "black ink remaining amount"), an image notifying the user of the remaining amount of the ink in a cartridge having the smallest remaining amount of the ink among the color cartridges 40Y, 40C and 40M (hereinafter referred to as the "color ink remaining amount"), and an image notifying the user of other operating situation of the printer 1.

The cartridge sensors 40*s*1 and 40*s*2 are arranged in the casing 1*x* at positions, respectively, at each of which one of the black cartridge 40B and the color cartridges 40Y, 40C and 40M is (are) installed in the casing 1*x*. Each of the cartridge sensors 40*s*1 and 40*s*2 outputs an ON signal to the CPU 51 in a case that the cartridge(s) corresponding thereto is (are) installed in the printer 1, and outputs an OFF signal to the CPU 51 in a case that the cartridge(s) corresponding thereto is (are) not installed in the printer 1.

Figure 7:
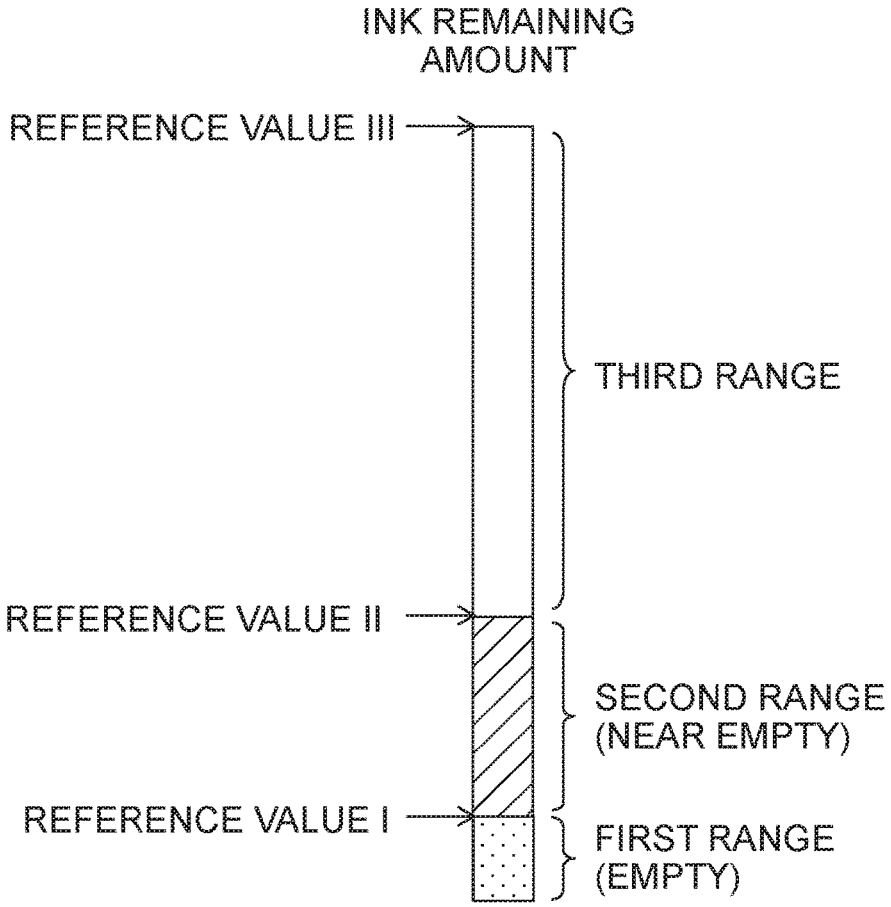
FIG. 7 is a view schematically depicting a remaining amount of ink in a cartridge.

As depicted in FIG. 7, the remaining amount of the ink in each of the cartridges 40B, 40Y, 40C and 40M (of which volumes are all the same) is included in a first range, a second range or a third range (the first range< the second range< the third range). A reference value III as the upper limit value of the third range (a value in a case that each of the cartridges 40B. 40Y, 40C and 40M is full), a reference value IT as the lower limit value of the third range and the upper limit value of the second range, and a reference value I as the lower limit value of the second range and the upper limit value of the first range are stored in the ROM 52. The lower limit value of the first range is zero (0) (a value in a case that each of the cartridges 40B, 40Y, 40C and 40M is empty). Here, there is such a problem that if the recording processing, etc., is executed in a state that the ink remaining amount is zero, then air flows into the inside of the head 12 when executing the recording processing, etc. in this state and thereby causes any jetting failure. In view of such a problem, a value is set as the reference value I in consideration of the difference (individual difference) in the ink amount among the cartridges 40B, 40Y, 40C and 40M in the full state thereof.

The CPU 51 detects the installment and replacement of the black cartridge 40B and the color cartridges 40Y, 40C and 40M individually, based on the signals from the cartridge sensors 40*s*1 and 40*s*2. Specifically, the CPU 51 detects the installment of the black cartridge 40B and/or the installment of the color cartridges 40Y, 40C and 40M in the printer 1 when the signal from the cartridge sensor 40*s*1 and/or the signal from the cartridge sensor 40*s*2 is/are changed from OFF to ON for the first time in the printer 1. Further, the CPU 51 detects the replacement of the black cartridge 40B and/or the replacement of the color cartridges 40Y, 40C and 40M when the signal from the cartridge sensor 40*s*1 and/or the signal from the cartridge sensor 40*s*2 is/are changed from ON to OFF and then change from OFF to ON (replacement/replenishment detecting processing).

After the CPU 51 detects the installment or the replacement of each of the black cartridge 40B and the color cartridges 40Y, 40C and 40M, the CPU 51 subtracts, regarding each of the colors of the inks, an ink consumption amount (an amount of the ink consumed in the recording processing and/or the purge operation performed after the cartridge has been installed or replaced) stored in the RAM 53 from the reference value III stored in the ROM 52, thereby detecting the remaining amount of the ink in each of the cartridges (remaining amount detecting processing). Further, in a case that the black ink remaining amount is in the first range, the CPU 51 controls the display 60 to notify the user that the black ink remaining amount is in the first range (for example, the CPU 51 controls the display 60 to display an image indicating that "replacement of the black cartridge is necessary"). In a case that the black ink remaining amount is in the second range, the CPU 51 controls the display 60 to notify the user that the black ink remaining amount is in the second range (for example, the CPU controls the display 60 to display an image indicating that "replacement timing of the black cartridge is near"). Furthermore, in a case that the color ink remaining amount is in the first range, the CPU 51 controls the display 60 to notify the user that the color ink remaining amount is in the first range (for example, the CPU 51 controls the display 60 to display an image indicating that "replacement of the color ink cartridges is necessary"). In a case that the color ink remaining amount is in the second range, the CPU 51 controls the display 60 to notify the user that the color ink remaining amount is in the second range (for example, the CPU 51 controls the display 60 to display an image indicating that "replacement timing of the color ink cartridges is near"). Moreover, in a case that the ink remaining amount in at least any one of the cartridges 40Y, 40C and 40M is in the first range, the CPU 51 does not execute the recording processing.

The ROM 52 stores, as ink amounts discharged in the purge operation, a plurality of purge amounts which are mutually different from each other, regarding each of the black ink and the color inks. The CPU 51 selects, for each of the black ink and the color inks, one or two of the plurality of purge amounts stored in the ROM 52 (in a case that only the liquid purge operation is performed, the CPU 51 selects one of the purge amounts as the liquid purge amount; in a case that a purge set in which the liquid purge operation is performed after the exhaust purge operation is performed, the CPU 51 selects one of the purge amounts as the exhaust purge amount, and selects one of the purge amounts as the liquid purge amount). The CPU 51 controls the rotational speed of the suction pump 30*p* such that the ink is discharged in the selected amount(s) in the purge operation.

Figure 8A:
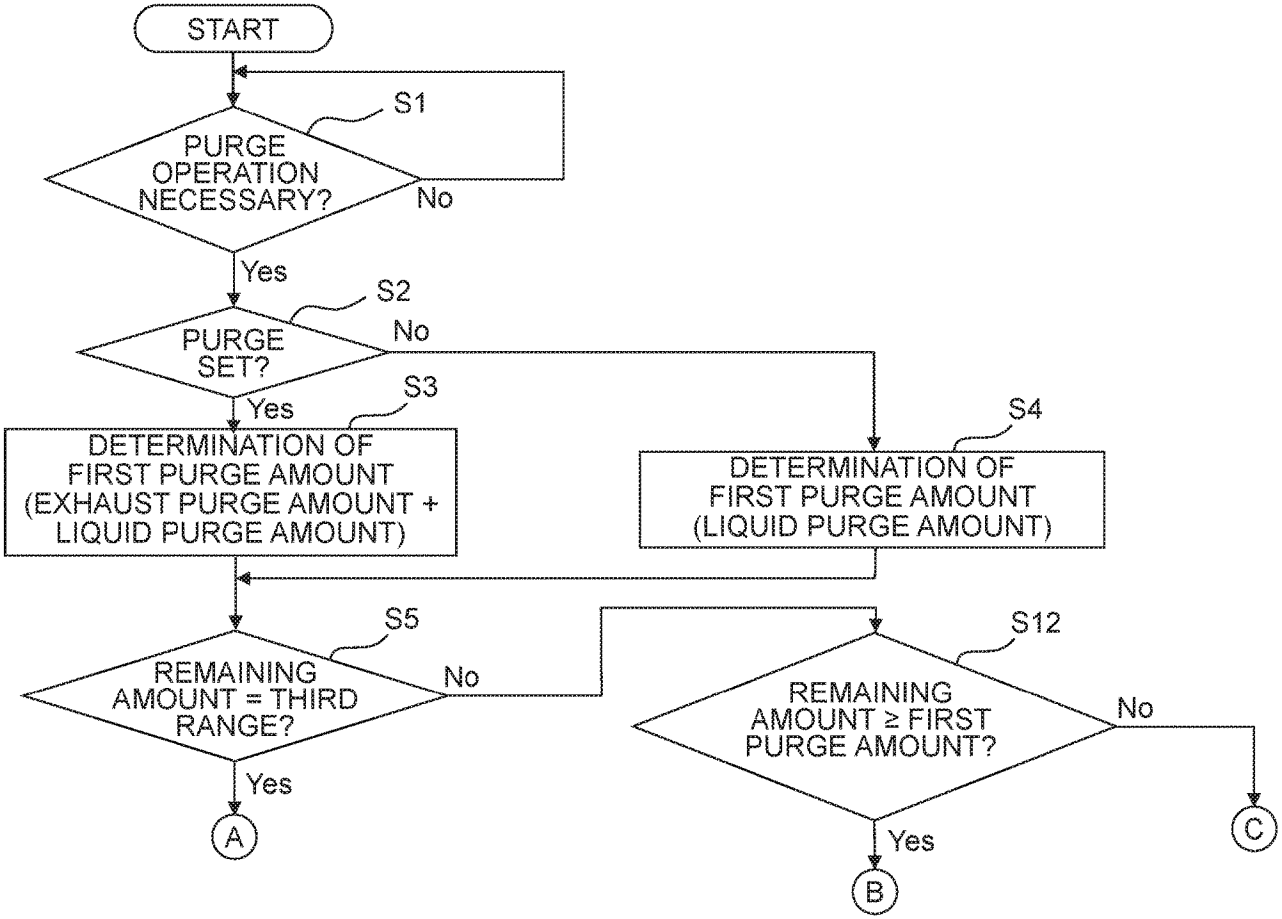
FIGS. 8A and 8B are a flow chart depicting a main routine according to a purge operation executed by a controller of the printer according to the embodiment of the present teaching.
Figure 8B:
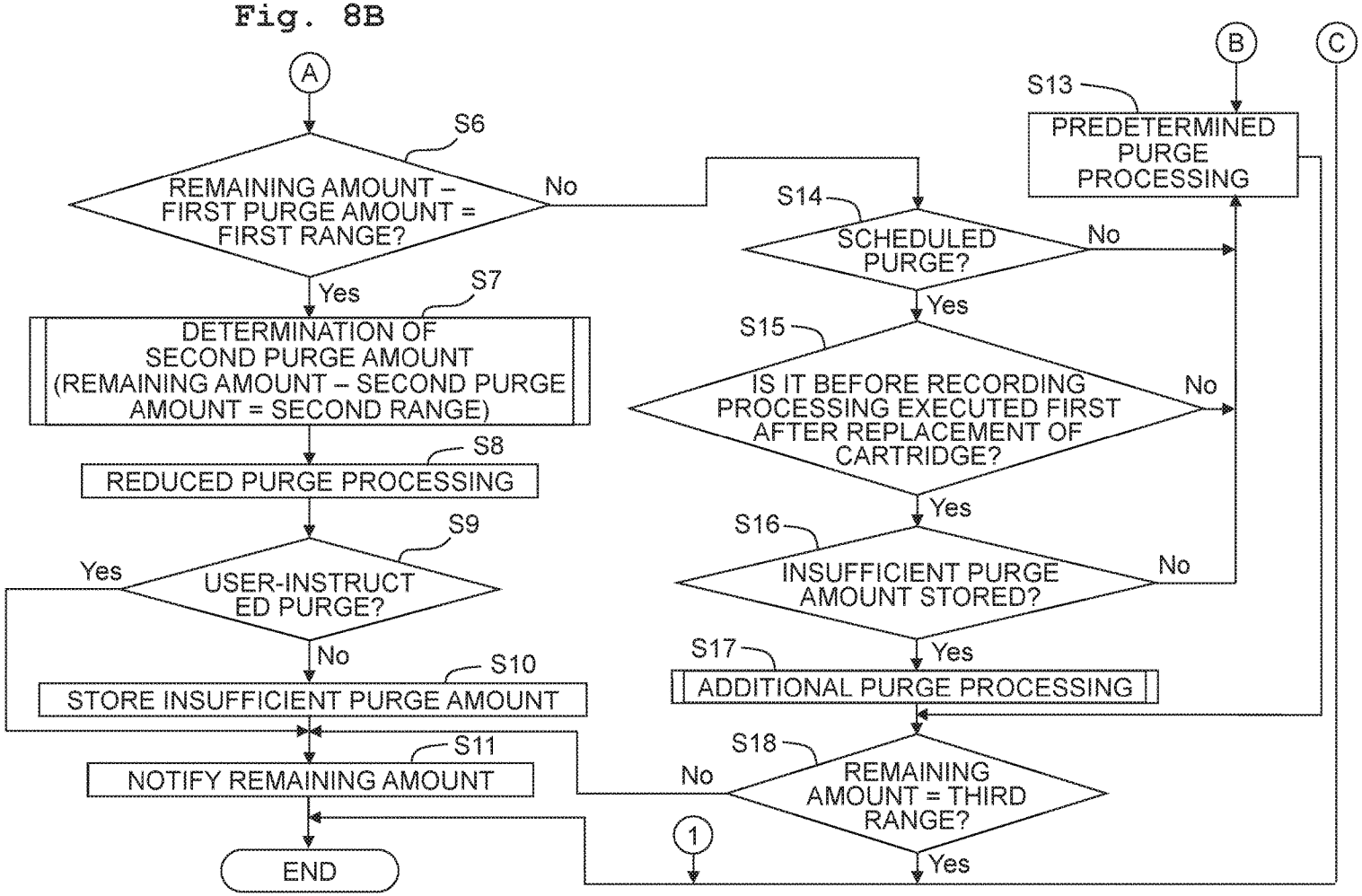

Next, an explanation will be given about the control executed by the controller 50 (CPU 51) regarding the purge operation, with reference to FIGS. 8A and 8B. Note that the control regarding the purge operation depicted in FIGS. 8A and 8B is executed individually for the black ink and the color inks.

At first, the CPU 51 determines whether or not the purge operation (only the liquid purge operation or the purge set) is necessary (S1).

It is determined that the purge operation is necessary, for example: in a case that a predetermined time is reached; in a case that a predetermined time has elapsed since execution of the purge operation immediately therebefore; in a case that an instruction for performing the purge operation is issued by a user; or before the recording processing is performed after any occurrence of error; etc. In the following explanation, a purge operation which is performed at a predetermined timing or which is performed in a case that a predetermined time has elapsed since execution of the purge operation immediately therebefore is referred to as a "scheduled purge", a purge operation which is performed based on an instruction from the user is referred to as a "user-instructed purge", and a purge operation which is performed before performing the recording processing is referred to as a "pre-recording purge".

Note that, however, in a case that the ink remaining amount is in the first range, it is not determined that the purge operation is necessary.

If the CPU 51 determines that the purge operation is not necessary (S1: NO), the CPU 51 repeats the processing of step S1. If the CPU 51 determines that the purge operation is necessary (S1: YES), the CPU 51 determines whether or not the purge operation determined to be necessary in step S1 is the purge set (S2).

If the CPU 51 determines that the purge operation determined to be necessary in step S1 is the purge set (S2: YES), the CPU 51 selects each of an exhaust purge amount as an amount of the ink to be discharged in the exhaust purge operation and a liquid purge amount as an amount of the ink to be discharged in the liquid purge operation, from a plurality of purge amounts which are stored in the ROM 52. The CPU 51 determines the sum of the selected exhaust purge amount and the selected liquid purge amount, as a first purge amount (S3). Note that the plurality of purge amounts are set in accordance with a dried state (jetting performance) of the jetting ports 12*x*. The CPU 51 selects the purge amount(s), by estimating the dried state of the jetting ports 12*x* from various conditions. For example, in a configuration wherein the jetting surface 12*a* is covered with the nozzle cap 32 when the recording processing is not executed so as to prevent the jetting ports 12 from being dried, if the jetting surface 12*a* is not covered with the nozzle cap 32, the CPU 51 selects a larger purge amount as the period of time during which the jetting surface 12*a* is not covered with the nozzle cap 32 is longer. Further; regarding the pre-recording purge, in such a case that any contact between the jetting surface 12*a* and the paper 100 has occurred immediately before recording; the CPU 51 selects a larger purge amount among the plurality of purge amounts than that selected in another case in which no such contact has occurred. Furthermore, regarding the user-instructed purge, the user is capable of selecting the intensity of the purge operation, and the CPU 51 selects a purge amount, among the plurality of purge amounts, depending on the intensity selected by the user.

If the CPU 51 determines that the purge operation determined to be necessary in step S1 is not the purge set (namely, only the liquid purge operation) (S2: NO), the CPU 51 selects a liquid purge amount as an amount of the ink to be discharged in the liquid purge operation from the plurality of purge amounts stored in the ROM 52, and the CPU 51 determines the selected purge amount, as a first purge amount (S4).

After step S3 or S4, the CPU 51 determines whether the ink remaining amount is in the third range (S5). If the CPU 51 determines that the ink remaining amount is in the third range (S5: YES), the CPU 51 determines whether an amount obtained by subtracting the first purge amount from the ink remaining amount is in the first range (namely, whether the ink remaining amount is in the first range if the purge operation is executed with the first purge amount) (S6).

If the CPU 51 determines that the amount obtained by subtracting the first purge amount from the ink remaining amount is in the first range (S6: YES), the CPU 51 determines a second purge amount (S7). The second purge amount is an amount obtained by reducing the first purge amount, and the amount obtained by subtracting the second purge amount from the remaining ink amount is in the second range (by discharging the ink in the second purge amount in the purge operation, the ink remaining amount is in the second range). The specifics of step S7 will be described in detail later on, with reference to FIGS. 9A and 9B.

After step S7, the CPU 51 executes a reduced purge processing (S8). In step S8, the CPU 51 controls the carriage motor 11*m*, the exhaust cap ascending/descending motor 311.*m*, the nozzle cap ascending/descending motor 32*m*, the opening/closing member ascending/descending motors 33*m*1 and 33*m*2, the suction pump 30*p* and the switching device 30*v* so as to execute the purge operation (only the liquid purge operation or the purge set) determined to be necessary in step S1, and controls the number of rotation of the suction pump 30*p* so as to discharge the ink in the second purge amount.

After step S8, the CPU 51 determines whether the reduced purge processing in step S8 corresponds to the user-instructed purge (S9).

If the CPU 51 determines that the reduced purge processing in step S8 does not correspond to the user-instructed purge (namely, the reduced purge processing corresponds to either the pre-recording purge or the scheduled purge) (S9: NO), the CPU 51 stores the difference between the second purge amount and the first purge amount in the RAM 53 as an insufficient purge amount (S10). Note that in a case that the purge set has been executed in the reduced purge processing, the insufficient purge amount is calculated for each of the exhaust purge amount and the liquid purge amount. In a case that only the liquid purge operation has been executed in the reduced purge processing, the insufficient purge amount is calculated for the liquid purge amount. After step S10, the CPU 51 executes the processing of step S11.

If the CPU 51 determines that the reduced purge processing in step S8 corresponds to the user-instructed purge (S9: YES), the CPU 51 executes the processing of step S11, without executing the processing of step S10.

In step S11, the CPU 51 controls the display 60 to notify the user that the ink remaining amount is in the first range or in the second range. In step S11 after step S8 has been performed, the CPU 51 controls the display 60 to notify the user that the ink remaining amount is in the second range. After step S11, the CPU 51 ends the routine.

Back to step S5 again, if the CPU 51 determines that the ink remaining amount is not included in the third range (When the ink remaining amount is in the first range, the CPU 51 does not determine in step S1 that the purge operation is necessary. Therefore, this means that the ink remaining amount is included in the second range) (S5: NO), the CPU 51 determines whether the ink remaining amount is equal to or more than the first purge amount (S12).

If the CPU 51 determines that the ink remaining amount is less than the first purge amount (S12: NO), the CPU 51 ends the routine, without performing the purge operation.

If the CPU 51 determines that the ink remaining amount is equal to or more than the first purge amount (S12: YES), the CPU 51 executes a predetermined purge processing (S13). In step S13, the CPU 51 controls the carriage motor 11*m*, the exhaust cap ascending/descending motor 31*m*, the nozzle cap ascending/descending motor 32*m*, the opening/closing member ascending/descending motors 33*m*1 and 33*m*2, the suction pump 30*p* and the switching device 30*v* to execute the purge operation (only the liquid purge operation or the purge set) determined to be necessary in step S1. Further, the CPU 51 controls the number of rotation of the suction pump 30*p* to discharge the ink in the first purge amount determined in step S3 or S4.

If the CPU 51 determines the amount obtained by subtracting the first purge amount from the ink remaining amount is not included in the first range (namely, the remaining amount is in the second or third range (S6: NO), the CPU 51 determines whether the purge operation determined to be necessary in step S1 corresponds to the scheduled purge (S14). If the CPU 51 determines that the purge operation determined to be necessary in step S1 corresponds to the scheduled purge (S14: YES), the CPU 51 determines whether the purge operation determined to be necessary in step S1 is a purge operation to be performed after the replacement of the black or color cartridge and before executing the recording processing first (S15). If the CPU 51 determines that the purge operation determined to be necessary in step S1 is a purge operation to be performed after the replacement of the black or color cartridge and before executing the recording processing first (S15: YES), the CPU 51 determines whether the insufficient purge amount is stored in the RAM 53 (S16). If the CPU 51 determines that the insufficient purge amount is stored in the RAM 53 (S16: YES), the CPU 51 executes an additional purge processing (S17). The specifics of S17 (additional purge processing) will be described in detail later on, with reference to FIG. 10.

If the CPU 51 determines that the purge operation determined to be necessary in step S1 does not correspond to the scheduled purge (namely, corresponds to the pre-recording purge or the user-instructed purge) (S14: NO), if the CPU 51 determines that the purge operation determined to be necessary in step S1 is not a purge operation to be executed after the replacement of the black or color cartridge and before executing the recording processing first (S15: NO), or if the CPU 51 determines that the insufficient purge amount is not stored in the RAM 53 (S16: NO), the CPU 51 executes the predetermined purge processing (S13).

After step S13 (predetermined purge processing), or after step S17 (additional purge processing), the CPU 51 determines whether the ink remaining amount is included in the third range (S18). If the CPU 51 determines that the ink remaining amount is included in the third range (S18: YES), the CPU 51 ends the routine. If the CPU 51 determines that the ink remaining amount is not included in the third range (namely, included in the first or second range) (S18: NO), the CPU 51 controls the display 60 to notify the user that the ink remaining amount is in the first or second range (S11), then ends the routine.

Next, a detailed explanation will be given about step S7 with reference to FIGS. 9A and 9B.

In step S7, at first, the CPU 51 specifies an amount of the ink presumed to be jetted from the jetting ports 12*x* in the recording processing after the reduced purge processing (provisional jetting amount α) (S21). The provisional jetting amount α is stored in the ROM 52 as an ink amount presumed to be necessary for performing recording on a predetermined number of the sheet 100.

After step S21, the CPU 51 determines whether the purge operation determined to be necessary in step S1 corresponds to the pre-recording purge (S22). If the CPU 51 determines that the purge operation determined to be necessary in step S1 corresponds to the pre-recording purge (S22: YES), the CPU 51 specifies an amount of the ink (first actual jetting amount β) to be jetted from the jetting ports 12*x* based on image data stored in the RAM 53 according to a recording processing to be performed after the purge operation (S23).

If the CPU 51 determines that the purge operation determined to be necessary in step S1 does not correspond to the pre-recording purge (S22: NO), the CPU 51 determines whether the purge operation determined to be necessary in step S1 corresponds to the user-instructed purge (S24). If the CPU 51 determines that the purge operation determined to be necessary in step S1 corresponds to the user-instructed purge (S24: YES), the CPU 51 specifies an amount of the ink (second actual jetting amount β) to be jetted from the jetting ports 12*x* in a recording processing to be performed in order to confirm the jetting performance of the jetting unit 10 (S25). The second actual jetting amount β is stored in the ROM 52.

After step S23 or step S25, the CPU 51 calculates an upper limit value X of the second purge amount by subtracting, from the ink remaining amount, the sum of the reference value I, the provisional jetting amount α and the actual jetting amount β (S26). On the other hand, if the CPU 51 determines that the purge operation determined to be necessary in step S1 does not correspond to the user-instructed purge (namely, corresponds to the scheduled purge) (S24: NO), the CPU 51 calculates the upper limit value X of the second purge amount by subtracting, from the ink remaining amount, the sum of the reference value I and the provisional jetting amount α (S27).

After step S26 or step S27, the CPU 51 determines whether the purge operation determined to be necessary in step S1 is the purge set (S28).

If the CPU 51 determines that the purge operation determined to be necessary in step S1 is the purge set (S28: YES), the CPU 51 determines the second purge amount by reducing, in the purge set, the amount of the ink to be discharged in the liquid purge operation in preference to the amount of the ink to be discharged in the exhaust purge operation.

Specifically, the CPU 51 firstly sets the first purge amount (the sum of the exhaust purge amount and the liquid purge amount) determined in step S3 to "Y" (S29). After step S29, the CPU 51 determines whether the "Y" is equal to or less than the upper limit value X of the second purge amount calculated in step S26 or S27 (S30).

If the CPU 51 determines that the "Y" is neither less than nor equal to (namely, that the "Y" is more than) the upper limit value X of the second purge amount (S30: NO), the CPU 51 determines whether the liquid purge amount in the "Y" is the smallest amount among the plurality of purge amounts stored in the ROM 52 (S31). If the CPU 51 determines that the liquid purge amount in the "Y" is not the smallest amount among the plurality of purge amounts (S31: NO), the CPU 51 selects a second smallest purge amount next to the currently selected purge amount, among the plurality of purge amounts stored in the ROM 52 (S32). After step S32, the CPU 51 sets, to the "Y", the sum of the exhaust purge amount determined in step S3 and the liquid purge amount selected in step S32 (the amount smaller than the liquid purge amount determined in step S3) (S33), and returns to step S30.

If the CPU 51 determines that the liquid purge amount in the "Y" is the smallest amount among the plurality of purge amounts (S31: YES), the CPU 51 determines whether the exhaust purge amount in the "Y" is the smallest amount among the plurality of purge amounts stored in the ROM 52 (S35). If the CPU 51 determines that the exhaust purge amount in the "Y" is not the smallest amount among the plurality of purge amounts (S35: NO), the CPU 51 selects a second smallest purge amount next to the currently selected purge amount, among the plurality of purge amounts stored in the ROM 52 (S36). After step S36, the CPU 51 sets, to the "Y", the sum of the exhaust purge amount selected in step S36 and the liquid purge amount which is the smallest amount among the plurality of purge amounts stored in the ROM 52 (S33), and returns to step S30.

If the CPU 51 determines that the "Y" is equal to or less than the upper limit value X of the second purge amount (S30: YES), the CPU 51 determines the "Y" as the second purge amount (S34), and ends the routine.

If the CPU 51 determines that the "Y" is neither less than nor equal to (namely, the "Y" is more than) the upper limit value X of the second purge amount (S30: NO), that the liquid purge amount in the "Y" is the smallest amount (S31: YES), and that the exhaust purge amount in the "Y" is the smallest amount (S35: YES), then referring back to FIGS. 8A and 8B, the CPU 51 ends the routine, without performing the purge operation.

If the CPU 51 determines that the purge operation determined to be necessary in step S1 is not the purge set (namely, only the liquid purge operation) (S28: NO), the CPU 51 sets, to the "Y", the first purge amount (liquid purge amount) determined in step S4 (S37). After S37, the CPU 51 determines whether the "Y" is equal to or less than the upper limit value X of the second purge amount calculated in step S26 or S27 (S38).

If the CPU 51 determines that the "Y" is neither less than nor equal to (namely, the "Y" is more than) the upper limit value X of the second purge amount (S38: NO), the CPU 51 determines whether the liquid purge amount in the "Y" is the smallest amount among the plurality of purge amounts stored in the ROM 52 (S39). If the CPU 51 determines that the liquid purge amount in the "Y" is not the smallest amount among the plurality of purge amounts (S39: NO), the CPU 51 selects a second smallest amount next to the currently selected purge amount, among the plurality of purge amounts stored in the ROM 52 (S40). After step S40, the CPU 51 sets, to the "Y", the purge amount selected in step S40 (the amount smaller than the liquid purge amount determined in step S3) (S41), and returns to step S38.

If the CPU 51 determines that the "Y" is equal to or less than the upper limit value X of the second purge amount (S38: YES), the CPU 51 determines the "Y" as the second purge amount (S34), and ends the routine.

If the CPU 51 determines that the "Y" is neither less than nor equal to (namely, the "Y" is more than) the upper limit value X of the second purge amount (S38: NO), and that the liquid purge amount in the "Y" is the smallest amount (S39: YES), then referring back to FIGS. 8A and 8B, the CPU 51 ends the routine, without performing the purge operation.

Here, since it is determined before step S7 that the amount obtained by subtracting the first purge amount from the ink remaining amount is in the first range (S6: YES), the first purge amount is consequently greater than the "the remaining amount−(minus) 1". Since the second purge amount determined in step S34 is equal to or less than the upper limit value X (remaining amount−(1+α+β), or remaining amount−(1+α)), the second purge amount is smaller than the first purge amount. Further, the second purge amount determined in step S34 is adjusted such that an amount obtained by subtracting the second purge amount from the ink remaining amount is included in the second range (such that an ink remaining amount after step S8 is included in the second range).

Figure 10:
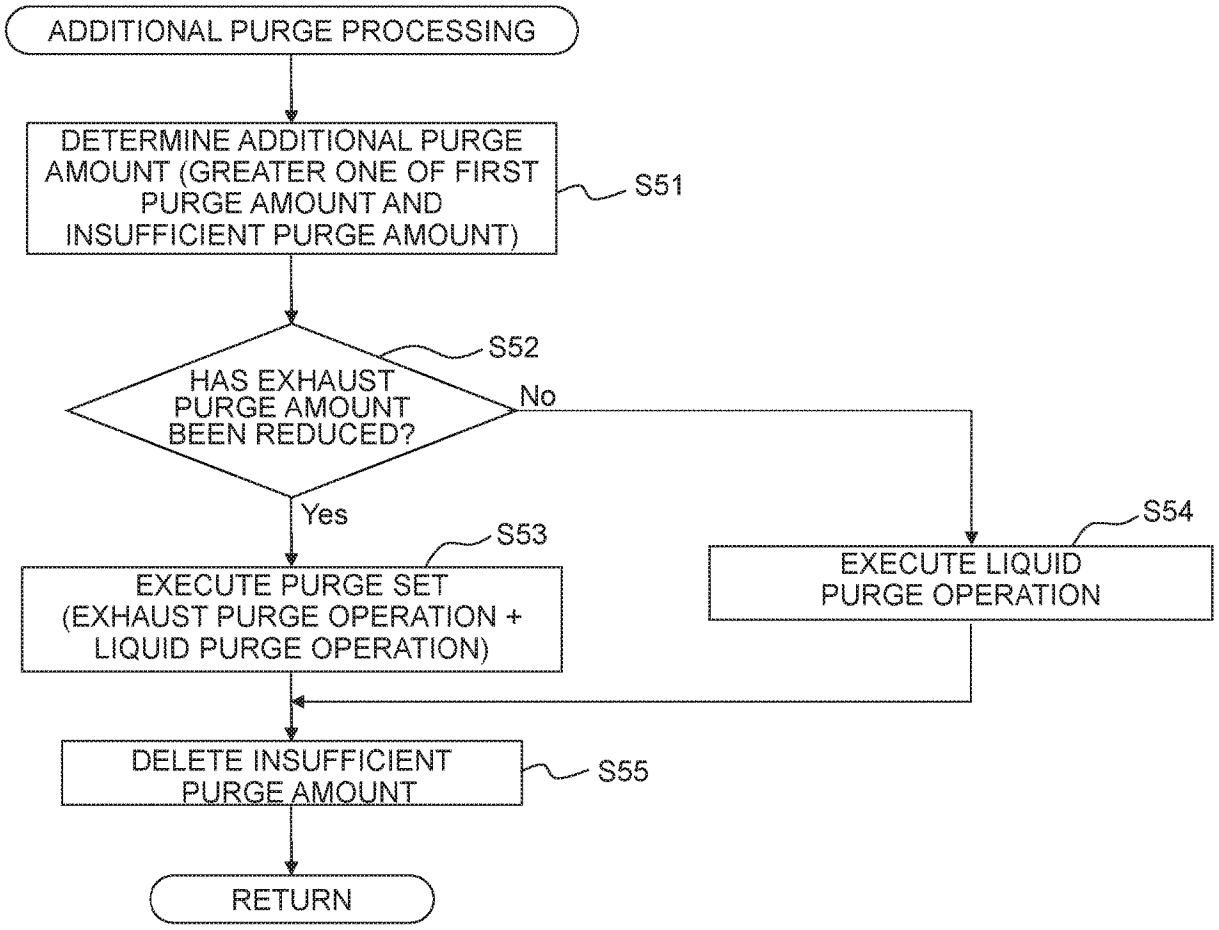
FIG. 10 is a flow chart depicting a sub routine according to an additional purge processing.

Next, a detailed explanation will be given about step S17, with reference to FIG. 10.

In step S17, at first, the CPU 51 determines an additional purge amount (S51). In step S51, the CPU 51 determines, as the additional purge amount, a larger one between the first purge amount regarding the purge operation (namely, the first purge amount determined in step S3 or S4 immediately therebefore) and the insufficient purge amount in the objective reduced purge processing (namely, the insufficient purge amount determined in step S16 as being stored in the RAM 53).

Note that the CPU 51 determines the additional purge amount such that an amount obtained by subtracting the additional purge amount from the ink remaining amount is not included in the first range (such that the ink remaining amount after executing the purge processing with the additional purge amount is not included in the first range).

After step S51, the CPU 51 determines whether the exhaust purge amount is reduced in the objective reduced purge processing (the reduced purge processing corresponding to the insufficient purge amount determined in step S16 as being stored in the RAM 53), based on the data regarding the insufficient purge amount stored in the RAM 53 (S52).

If the CPU 51 determines that the exhaust purge amount has been reduced in the objective reduced purge processing (S52: YES), the CPU 51 controls the carriage motor 11*m*, the exhaust cap ascending/descending motor 31*m*, the nozzle cap ascending/descending motor 32*m*, the opening/closing member ascending/descending motors 33*m*1 and 33*m*2, the suction pump 30*p* and the switching device 30*v* so as to execute the purge set. While performing the above control, the CPU 51 controls the number of rotation of the suction pump 30*p* such that the ink is discharged in the exhaust purge operation in the additional purge amount determined in step S51 and that the ink is discharged in the liquid purge operation in the first purge amount determined in step S3 or S4 (S53).

If the CPU 51 determines that the exhaust purge amount has not been reduced in the objective reduced purge processing (S52: NO), the CPU 51 controls the carriage motor 11*m*, the exhaust cap ascending/descending motor 31*m*, the nozzle cap ascending/descending motor 32*m*, the opening/closing member ascending/descending motors 33*m*1 and 33*m*2, the suction pump 30*p* and the switching device 30*v* so as to execute the liquid purge operation. While performing the above control, the CPU 51 controls the number of rotation of the suction pump 30*p* such that the ink is discharged in the additional purge amount determined in step S51 (S54).

After step S53 or S54, the CPU 51 deletes the insufficient purge amount stored in RAM 53 (S55), and ends the routine.

As described above, according to the present embodiment, in a case that the remaining amount is included in the first range if the purge operation is executed with the first purge amount in a state that the remaining amount is included in the third range (S6: YES), the purge operation is executed with the second purge amount such that the remaining amount is included in the second range after the execution of the purge operation (S7, S8). After the purge operation is executed in a state that the remaining amount is included in the third range, the user can receive the notification regarding the second range. Therefore, it is possible to secure the time al lowing the user to prepare the replacement of the cartridges 40B, 40Y, 40C and 40M. Further, since there arises no need to replace the cartridge 40B and/or the cartridge 40Y, 40C and 40M in a state that the remaining amount is in the third range, it is possible to prevent any wasteful discarding of the non-used ink and/or to reduce the burden on the user.

The CPU 51 determines the second purge amount such that the ink remaining amount after the reduced purge processing is equal to or more than the sum of the upper limit value (reference value I) of the first range and the provisional jetting amount α (S27). According to this configuration, it is possible to avoid such a situation that the recording processing cannot be executed after the reduced purge processing.

In a case that the reduced purge processing is the pre-recording purge processing (S22: YES), the CPU 51 specifies an amount of the ink (first actual jetting amount β) to be jetted from the jetting ports 12*x* based on image data according to the recording processing (S23). Then, the CPU 51 determines the second purge amount such that the ink remaining amount after the reduced purge processing is equal to or more than the sum of the upper limit value (reference value I) of the first range, the provisional jetting amount α and the first actual jetting amount β (S26). According to this configuration, it is possible to execute a recording processing to some extent, in addition to the recording operation which is to be executed following the pre-recording purge processing.

In a case that the reduced purge processing is the user-instructed purge processing (S24: YES), the CPU 51 specifies the amount of the ink (second actual jetting amount β) to be jetted from the jetting ports 12*x* in a recording processing to be performed in order to confirm the jetting performance of the jetting unit 10 (S25). Further, the CPU 51 determines the second purge amount such that the ink remaining amount after the reduced purge processing is equal to or more than the sum of the upper limit value (reference value I) of the first range, the provisional jetting amount α and the second actual jetting amount β (S26). According to this configuration, it is possible to execute a recording processing to some extent, in addition to the recording processing for confirming jetting performance of the jetting unit to be executed following the user-instructed purge processing.

The CPU 51 executes the insufficient purge amount storing processing (S10) of storing the difference between the second purge amount and the first purge amount as the insufficient purge amount. Further, after the reduced purge processing has been executed and before the first recording processing is executed after the replacement of the cartridge 40B and/or the cartridge 40Y, 40C and 40M has been detected (S15: YES, then S16: YES), the CPU 51 executes the additional purge processing (S17) by controlling the suction pump 30*p* such that the ink is jetted in an amount equal to or more than the insufficient purge amount. According to this configuration, the jetting performance can be restored in a more ensured manner by performing the additional purge processing.

In the additional purge processing, the CPU 51 controls the suction pump 30*p* such that the ink is discharged in a purge amount which is a greater one of the first purge amount and the insufficient purge amount regarding the purge operation (S51). According to this configuration, it is possible to restore the jetting performance while suppressing the consumption amount of the ink.

The CPU 51 executes the insufficient purge amount storing processing (S10) in a case that the reduced purge processing is the pre-recording purge processing or in a case that the reduced purge processing is the scheduled purge processing (S9: NO). On the other hand, the CPU 51 does not execute the insufficient purge amount storing processing in a case that the reduced purge processing is the user-instructed purge processing (S9: YES). With respect to the user-instructed purge processing, the necessity for restoring the jetting performance is not as much as high as regarding the pre-recording purge processing or the scheduled purge processing. According to the above-described configuration, since the insufficient purge amount is not stored in a case that the reduced purge processing is the user-instructed purge processing, it is possible to simplify the control and consequently to suppress the consumption amount of the ink.

In the scheduled purge processing (S14: YES), the CPU 51 executes the additional purge processing (S17). In a case that the ink is discharged in the amount equal to or more than the insufficient purge amount in the pre-recording purge processing, it takes time before the recording processing is started, which in turn makes it impossible to realize a high-speed recording. According to the above-described configuration, it is possible to solve this problem by causing, in the scheduled purge, the liquid to be discharged in an amount equal to or more than the insufficient purge amount.

In a case that the exhaust purge amount is reduced in the reduced purge processing (S52: YES), the CPU 51 controls the suction pump 30*p* such that the purge set including the exhaust purge operation in which the ink is discharged in an amount equal to or more than the insufficient purge amount is executed in the additional purge processing (S53). On the other hand, in a case that the exhaust purge amount is not reduced in the reduced purge processing (S52: NO), the CPU 51 controls the suction pomp 30*p* such that the liquid purge operation in which the liquid is discharged in an amount equal to or more than the insufficient purge amount is executed in the additional purge processing, without executing the exhaust purge operation in the additional purge processing (S54). In the purge set, the liquid purge operation is executed, after discharging the gas together with the ink, by the exhaust purge operation, from the liquid channel (the ink storing chamber 13*x*1 and/or the ink channel 15*x*) located on the upstream side relative to the jetting ports 12*x*. By doing so, it is possible to obtain such an effect that the ink is discharged smoothly from the jetting ports 12*x* in the liquid purge operation. On the other hand, in a case that the purge set is executed excessively, there arises such a problem that it takes the time for the purge operation as a whole, to the extent corresponding to the exhaust purge operation, and that the consumption amount of the ink is also increased. In view of this, it is determined whether the exhaust purge amount is reduced. If it is determined that the exhaust purge amount is not reduced, only the liquid purge operation is executed, without executing the exhaust purge operation, thereby making it possible to suppress the occurrence of the above-described problem.

If the CPU 51 determines that the purge operation determined to be necessary in step S1 is the purge set (S28: YES), the CPU 51 reduces, in the purge set, the amount of the ink to be discharged in the liquid purge operation in preference to the amount of the ink discharged in the exhaust purge operation (S31 to S36). In the purge set, the liquid purge operation is executed after discharging the gas together with the ink, by the exhaust purge operation, from the liquid channel (the ink storing chamber 13*x*1 and/or the ink channel 15*x*) located on the upstream side relative to the jetting ports 12*x*. By doing so, it is possible to obtain such an effect that the ink is discharged smoothly from the jetting ports 12*x* in the liquid purge operation. In view of this, in the purge set, it is configured such that the amount of the ink discharged by the exhaust purge operation is not reduced as much as possible. By doing so, it is possible to suppress the occurrence of such a problem that the above-described effect cannot be obtained.

Next, an explanation will be given about another embodiment of the present teaching.

The another embodiment is different from the above-described embodiment in view of the content of step S7, but the remaining contents of the another embodiment are same as those in the above-described embodiment.

Figure 9A:
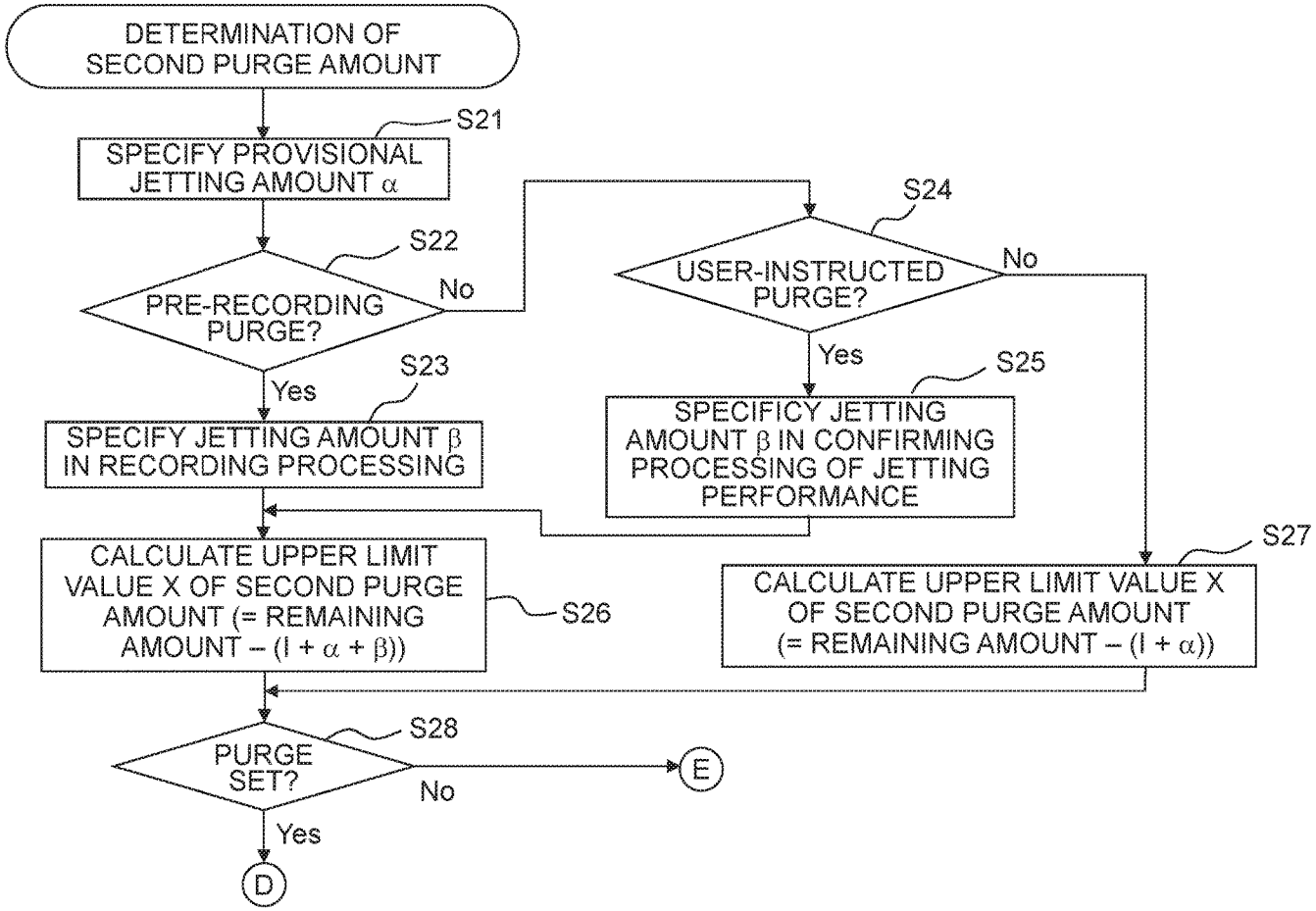
FIGS. 9A and 9B are a flow chart depicting a sub routine according to a determining processing for determining a second purge amount.
Figure 9B:
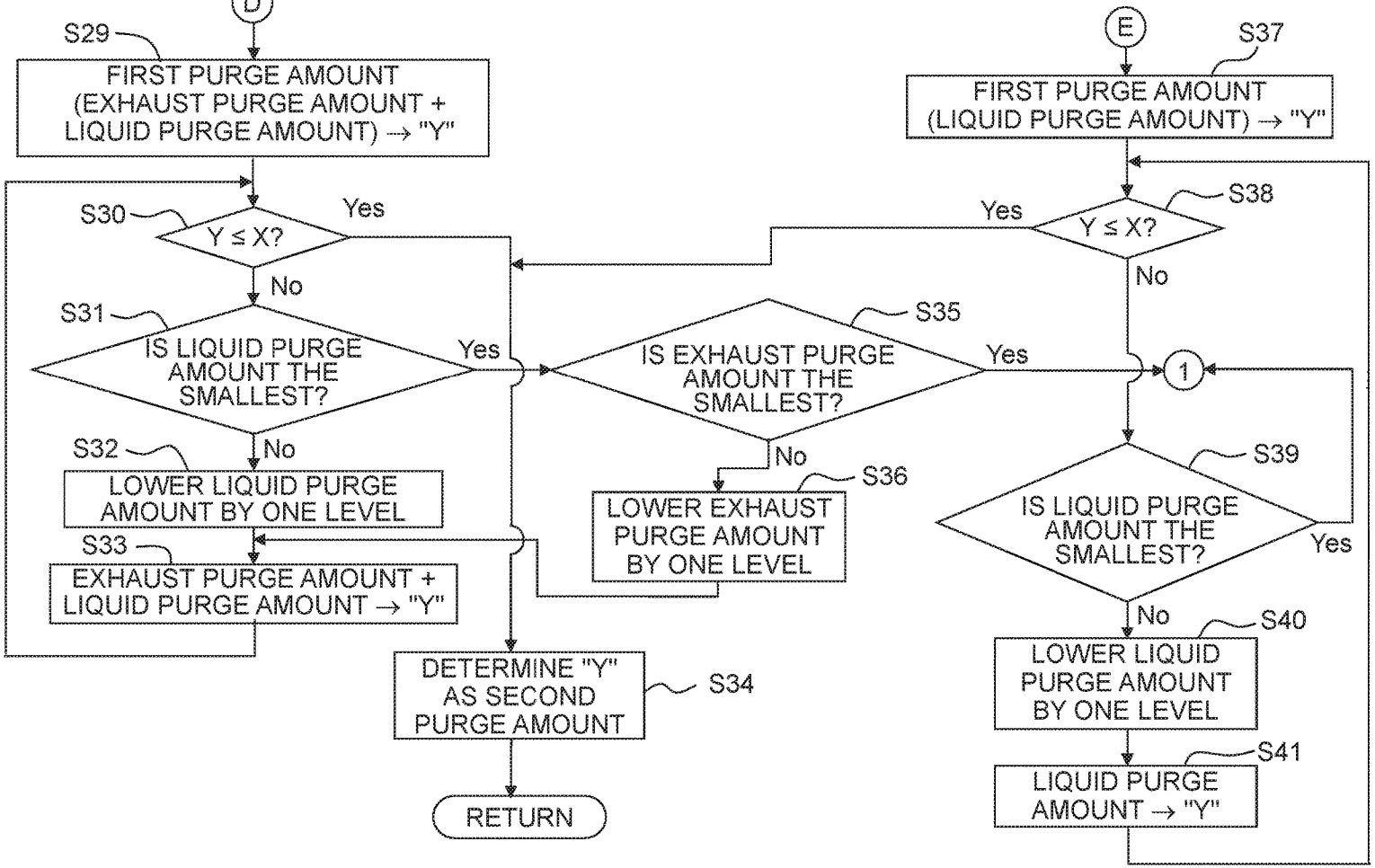

In the another embodiment, in step S7, the CPU 51 does not execute the sub routine as depicted in FIGS. 9A and 9B; rather, the CPU 51 determines a purge amount, of which difference from the first purge amount is the smallest among the plurality of purge amounts and which is smaller than the first purge amount, as the second purge amount.

According to the another configuration, it is possible to obtain a jetting performance close to a desired jetting performance, even if the reduced purge processing is executed.

The preferred embodiments of the present teaching have been explained above. The present teaching, however, is not limited to these embodiments. Various changes in the design may be made without departing from the claims.

The tank is not limited to the replaceable tank (cartridge); the tank may be a tank of a liquid-replenishing system. In a case that the tank is a tank of the liquid-replenishing type, the controller detects the replenishment of the tank with a liquid, instead of detecting the replacement of the tank. The number of the tank is not limited to 4 (four); the number of the tank may be any number not less than 1 (one). In a case that a plurality of tanks are disposed in the casing 1*x*, it is allowable to perform the detection of the remaining amount and the notification regarding the remaining amount with respect to each of the plurality of tanks; it is also allowable to perform the detection of the remaining amount and the notification regarding the remaining amount with respect to the plurality of tanks as a whole (for example, with the average of the remaining amounts of the plurality of tanks, or with the smallest remaining amount among those of the plurality of tanks, as the reference).

The purge unit is not limited to the suction pump; the purge unit may be an actuator configured to drive the jetting unit in the recording processing. The purge unit is not limited to those configured to perform the purge operation by the suction; the purge unit may perform the purge operation by pressurization. In the above-described embodiment, the purge operation (exhaust purge operation and liquid purge operation) is performed individually for the black ink and for the color inks. However, there is no limitation to this. For example, the purge operation may be performed individually for each of the colors, including the black ink, or may be performed commonly for all the colors. It is allowable that the purge unit does not execute the exhaust purge operation.

The controller is not limited to those configured to select the first purge amount and/or the second purge amount each from the plurality of purge amounts; the controller may determine the first purge amount and/or the second purge amount by performing calculation based on respective conditions. A part of each processing performed by the controller may be realized by hardware, and a remaining part of each processing may be realized by software. For example, in the above-described embodiment, the CPU 51 (controller) calculates the ink remaining amount based on the ink amount consumed in the recording processing and/or the purge operation. However, it is allowable that a remaining amount sensor (hardware) is provided; and that the CPU 51 detects the remaining amount based on a detection signal from the remaining amount sensor.

In the above-described embodiment, from the state that the remaining amount is the upper limit value of the third range (reference value III), the CPU 51 starts to detect the remaining amount by subtracting the amount of the ink consumed in the recording processing and/or the purge operation from the upper limit value of the third range. However, there is no limitation to this. It is allowable, for example, that until the remaining amount reaches the upper limit value (reference value II) of the second range from the upper limit value of the third range (reference value III), the CPU 51 does not perform the calculation regarding the detection of remaining amount, and that after the CPU 51 detects, by the signal from the remaining amount sensor, that the remaining amount has reached the upper limit value (reference value II) of the second range, the CPU 51 performs the calculation regarding the detection of remaining amount. In such a case, the CPU 51 detects that the remaining amount is included in the third range based on that the detection signal from the remaining amount sensor is an OFF signal.

The notifying unit (alarm) is not limited to the display (configured to output an image), and may be a speaker (configured to output a sound), etc. Further, as the content of notification that the remaining amount is in the first or second range is not limited to the notifications that "replacement of the cartridge is necessary", "replacement timing of the cartridge is near"; for example, in a case that the tank is of the liquid replenishing-type, the notification may be "replenishment of the cartridge with the ink is necessary", "timing of replenishing the cartridge with the ink is near".

The present teaching is not limited to the color printer; the present teaching is applicable also to a monochrome printer. Further, the present teaching is not limited to the printer; the present teaching is applicable also to a facsimile machine, copying machine, a multi-function peripheral, etc.

What is claimed is:

1. A liquid jetting apparatus comprising:

a jetting unit connected to a tank storing liquid, and having jetting ports through which the liquid supplied from the tank is jetted;

a purge unit configured to perform a purge operation for discharging the liquid from the jetting unit, a display configured to notify a user selectively that a remaining amount, of the liquid remaining in the tank, is included in a first range, and that the remaining amount is included in a second range greater than the first range; and a controller configured to control the jetting unit, the purge unit and the display, wherein the controller is configured to:

determine a first purge amount which is an amount of the liquid to be discharged in the purge operation;

detect the remaining amount;

in a case that the detected remaining amount is included in a third range greater than the second range, and that the remaining amount is included in the first range if the purge operation is executed with the first purge amount, determine a second purge amount which is obtainable by reducing the first purge amount, such that the remaining amount is included in the second range after the purge operation is executed with the second purge amount, control the purge unit to discharge the liquid in the second purge amount; and control the display to notify the user that the remaining amount is included in the second range, after the liquid has been discharged in the second purge amount.

2. The liquid jetting apparatus according to claim 1, further comprising a memory configured to store a plurality of purge amounts mutually different from each other, as amounts of the liquid to be discharged in the purge operation, wherein the controller is configured to determine a purge amount, which is included in the plurality of purge amounts and of which difference from the first purge amount is the smallest, as the second purge amount.

3. The liquid jetting apparatus according to claim 1, wherein the controller is configured further to:

control the jetting unit based on image data to record an image onto a recording medium; and specify a provisional jetting amount, which is presumed to be jetted from the jetting unit if the image is recorded onto the recording medium after the liquid has been discharged in the second purge amount, and wherein the controller is configured to determine the second purge amount, such that the remaining amount after the liquid has been discharged in the second purge amount is equal to or more than a sum of an upper limit value of the first range and the provisional jetting amount.

4. The liquid jetting apparatus according to claim 3, wherein the controller is configured further to specify a first actual jetting amount, which is to be jetted from the jetting unit if the image is recorded onto the recording medium after the liquid has been discharged in the second purge amount, and wherein the controller is configured to determine the second purge amount, such that the remaining amount after the liquid has been discharged in the second purge amount is equal to or more than a sum of the upper limit value of the first range, the provisional jetting amount and the first actual jetting amount.

5. The liquid jetting apparatus according to claim 3, wherein the controller is configured further to specify a second actual jetting amount, which is to be jetted from the jetting unit in order to confirm jetting performance of the jetting unit, in a case that the liquid is discharged in the second purge amount based on an instruction of the user, and wherein the controller is configured to determine the second purge amount, such that the remaining amount after the liquid has been discharged in the second purge amount is equal to or more than a sum of the upper limit value of the first range, the provisional jetting amount and the second actual jetting amount.

6. The liquid jetting apparatus according to claim 1, wherein the controller is configured further to:

control the jetting unit based on image data to record an image onto a recording medium;

detect replacement of the tank or replenishment of the tank with the liquid;

store, in a memory, a difference between the second purge amount and the first purge amount as an insufficient purge amount; and control the purge unit to execute an additional purge processing of discharging the liquid in an amount equal to or more than the insufficient purge amount, after the liquid has been discharged in the second purge amount and the replacement of the tank or the replenishment of the tank with the liquid has been detected, and before the image is recorded onto the recording medium first.

7. The liquid jetting apparatus according to claim 6, wherein in the additional purge processing, the controller is configured to control the purge unit to discharge the liquid in an amount which is a greater one of the first purge amount and the insufficient purge amount.

8. The liquid jetting apparatus according to claim 6, wherein the controller is configured to:

store the insufficient purge amount in the memory, at least in one of a case that the image is to be recorded onto the recording medium after the liquid has been discharged in the second purge amount, a case that the liquid is to be discharged in the second purge amount in a predetermined timing, and a case that the liquid is to be discharged in the second purge amount after a predetermined time has elapsed since execution of the purge operation immediately therebefore; and not to store the insufficient purge amount in the memory, in a case that the liquid is to be discharged in the second purge amount based on an instruction of the user.

9. The liquid jetting apparatus according to claim 6, wherein the controller is configured to execute the additional purge processing in a case that the purge operation is to be performed at a predetermined timing or after a predetermined time has elapsed since execution of the purge operation immediately therebefore.

10. The liquid jetting apparatus according to claim 6, wherein the jetting unit includes a liquid channel communicating the tank with the jetting ports, the purge unit is configured to execute, as the purge operation, an exhaust purge operation for discharging gas in the liquid channel together with the liquid in the liquid channel, and a liquid purge operation for discharging the liquid from the jetting ports, the controller is configured further to determine whether a purge set, for executing the liquid purge operation after the exhaust purge operation, is to be executed, if the controller determines that the purge set is to be executed, then the controller is configured to determine, as the first purge amount, a sum of an exhaust purge amount which is an amount of the liquid to be discharged in the exhaust purge operation and a liquid purge amount which is an amount of the liquid to be discharged in the liquid purge operation, if the exhaust purge amount is to be reduced, then the controller is configured to control the purge unit to execute, in the additional purge processing, the purge set including the exhaust purge operation in which the liquid is discharged in an amount equal to or more than the insufficient purge amount, and if the exhaust purge amount is not to be reduced, then the controller is configured to control the purge unit to execute, in the additional purge processing, the liquid purge operation in which the liquid is discharged in the amount equal to or more than the insufficient purge amount, without executing the exhaust purge operation.

11. The liquid jetting apparatus according to claim 1, wherein the jetting unit includes a liquid channel communicating the tank with the jetting ports, the purge unit is configured to execute, as the purge operation, an exhaust purge operation for discharging gas in the liquid channel together with the liquid in the liquid channel, and a liquid purge operation for discharging the liquid from the jetting ports, the controller is configured further to determine whether a purge set, for executing the liquid purge operation after the exhaust purge operation, is to be executed, and if the controller determines that the purge set is to be executed, then the controller is configured to determine the second purge amount by reducing an amount of the liquid to be discharged in the liquid purge operation, in preference to an amount of the liquid to be discharged in the exhaust purge operation.

12. A liquid jetting apparatus comprising:

a tank;

a jetting unit connected to the tank storing liquid, and having jetting ports through which the liquid supplied from the tank is jetted;

a purge unit, an alarm; and a controller configured to control the jetting unit, the purge unit and the alarm, wherein the controller is configured to:

determine a first purge amount which is an amount of the liquid to be discharged in a purge operation for discharging the liquid from the jetting unit;

detect the remaining amount of the liquid in the tank;

in a case that the detected remaining amount is included in a third range greater than a second range, and that the remaining amount is included in a first range less than the second range if the purge operation is executed with the first purge amount, determine a second purge amount which is obtainable by reducing the first purge amount, such that the remaining amount is included in the second range after the purge operation is executed with the second purge amount;

control the purge unit to discharge the liquid in the second purge amount; and control the alarm to notify the user that the remaining amount is included in the second range, after the liquid has been discharged in the second purge amount.

13. The liquid jetting apparatus according to claim 12, further comprising a memory configured to store a plurality of purge amounts mutually different from each other, as amounts of the liquid to be discharged in the purge operation, wherein the controller is configured to determine a purge amount, which is included in the plurality of purge amounts and of which difference from the first purge amount is the smallest, as the second purge amount.

14. The liquid jetting apparatus according to claim 12, wherein the controller is configured further to:

control the jetting unit based on image data to record an image onto a recording medium; and specify a provisional jetting amount, which is presumed to be jetted from the jetting unit if the image is recorded onto the recording medium after the liquid has been discharged in the second purge amount, and wherein the controller is configured to determine the second purge amount, such that the remaining amount after the liquid has been discharged in the second purge amount is equal to or more than a sum of an upper limit value of the first range and the provisional jetting amount.

* * * * *